US010968083B2

(12) United States Patent
Schoerghofer et al.

(10) Patent No.: US 10,968,083 B2
(45) Date of Patent: Apr. 6, 2021

(54) CRANE COMPRISING AN IMAGE ACQUISITION SYSTEM

(71) Applicant: EPSILON Kran GmbH., Salzburg (AT)

(72) Inventors: Simon Schoerghofer, Puch bei Hallein (AT); Martin Galler, Adnet (AT)

(73) Assignee: EPSILON KRAN GMBH, Salzburg (AT)

( * ) Notice: Subject to any disclaimer, the term of this patent is extended or adjusted under 35 U.S.C. 154(b) by 0 days.

(21) Appl. No.: 16/509,743

(22) Filed: Jul. 12, 2019

(65) Prior Publication Data

US 2020/0017335 A1 Jan. 16, 2020

(30) Foreign Application Priority Data

Jul. 13, 2018 (EP) ..... 18183443

(51) Int. Cl.
*B66C 13/46* (2006.01)
*B66C 13/44* (2006.01)

(52) U.S. Cl.
CPC ..... *B66C 13/46* (2013.01); *B66C 13/44* (2013.01); *B66C 2700/08* (2013.01)

(58) Field of Classification Search
CPC ..... B66C 13/46; B66C 13/44; B66C 2700/08
See application file for complete search history.

(56) References Cited

U.S. PATENT DOCUMENTS 9,300,954 B2 3/2016 Tanizumi et al.
9,773,337 B2 * 9/2017 Delplace ..... G06T 13/20
9,856,662 B2 1/2018 Vierkotten et al.
2005/0232733 A1 * 10/2005 Maurer ..... B66C 13/085 414/334
2013/0183028 A1 7/2013 Chapman
2014/0104426 A1 * 4/2014 Boegel ..... B60R 1/06 348/148
2015/0249821 A1 9/2015 Tanizumi et al.
2017/0167149 A1 6/2017 Vierkotten et al.
(Continued)

FOREIGN PATENT DOCUMENTS

CN 104340871 2/2015
DE 10 2014 009 165 12/2015
(Continued)

OTHER PUBLICATIONS

Search Report dated Jan. 3, 2019 in European Patent Application No. 18183443, with English translation.

*Primary Examiner* — Mohamed Barakat
(74) *Attorney, Agent, or Firm* — Wenderoth, Lind & Ponack, L.L.P.

(57) ABSTRACT

A crane includes an image acquisition system arranged to be raised and lowered by a lifting device for acquisition of a region of a crane environment. The image acquisition system is arranged on a jib that extends straight, of the lifting device. The image acquisition system is moveable upwardly by an extension of the jib from a lift column and is lowerable by retraction of the jib into the lift column into a transport position in which the jib is disposed substantially completely in the lift column and the image acquisition system is moved towards the lift column. The image acquisition system is arranged on a tip of the jib forming a highest point of the jib.

18 Claims, 9 Drawing Sheets

(56) References Cited

U.S. PATENT DOCUMENTS

| | | | | |
|---|---|---|---|---|
| 2018/0023754 | A1* | 1/2018 | Hashiguchi | F16M 11/24 396/428 |
| 2018/0141787 | A1 | 5/2018 | Rudy et al. | |
| 2018/0141788 | A1 | 5/2018 | Rudy et al. | |
| 2018/0141789 | A1* | 5/2018 | Rudy | B66C 13/16 |
| 2018/0143011 | A1 | 5/2018 | Rudy et al. | |

FOREIGN PATENT DOCUMENTS

| | | |
|---|---|---|
| EP | 3 235 773 | 10/2017 |
| EP | 3 323 767 | 5/2018 |
| JP | 6-258713 | 9/1994 |
| JP | 9-3978 | 1/1997 |
| JP | 11120813 | 4/1999 |
| JP | 2002-240628 | 8/2002 |
| JP | 2003-15213 | 1/2003 |
| JP | 2009-286216 | 12/2009 |
| JP | 2014-201431 | 10/2014 |
| JP | 2015-156538 | 8/2015 |
| JP | 2016-94693 | 5/2016 |
| KR | 2000-0017212 | 3/2000 |
| KR | 10-2009-0069823 | 7/2009 |
| WO | 2014/010579 | 1/2014 |
| WO | 2017/164781 | 9/2017 |

* cited by examiner

CRANE COMPRISING AN IMAGE ACQUISITION SYSTEM

BACKGROUND OF THE INVENTION

The invention concerns a crane and a carrier vehicle having such a crane.

A crane which is not in accordance with the general kind set forth is known from WO 2017/164781 A1. FIGS. 7*a* and 7*b* of that document show a crane with an image acquisition system arranged in such a way that it can be raised and lowered by a lifting device, for image acquisition of a region of a crane environment, which is not directly viewable for an operator of the crane, wherein the image acquisition system is disposed at a jib portion which extends in a straight line of the lifting device (the last part which is disposed on the innermost horizontally extending jib). In order to lower the image acquisition system into a transport position in which the image acquisition system is moved towards the lift column the horizontally extending jibs and the vertically extending jib have to be retracted. The horizontally extending jibs limit the field of view of the image acquisition system.

A crane of the general kind set forth is now known on the market. The image acquisition system is arranged beneath a tip of the jib beside the jib. In this case also the field of view of the image acquisition system is restricted.

SUMMARY OF THE INVENTION

The object of the invention is to provide a crane of the general kind set forth, which permits a greater field of view for the image acquisition system, and a carrier vehicle having such a crane.

That object is attained by a crane having the features according to a first aspect of the invention, and a carrier vehicle having such a crane. Advantageous embodiments of the invention are defined in the appendant claims.

Because it is provided with the invention that the image acquisition system is arranged on a tip of the jib that forms a highest point of the jib the field of view is restricted neither by horizontally extending jibs nor by a jib projecting upwardly beside the image acquisition system. That basically permits a field of view of 360° in a horizontal plane, the invention not being restricted to such an all-round view. For example a field of view of at least 290° may be sufficient.

A further advantage is that the image acquisition system is better protected in the transport position as it does not extend away from the lift column.

In addition the arrangement provides a more compact structural shape.

In an embodiment of the invention it is provided that the image acquisition system is arranged rigidly relative to the tip of the jib. It is advantageous in that respect that no adjustment mechanism is required for the image acquisition system, by virtue of the large field of view according to the invention.

In an embodiment of the invention it is provided that the image acquisition system has at least one and preferably at least three cameras which are preferably arranged in a common housing. Alternatively the use of a single camera is also conceivable, which has an optical imaging means which makes use of the large field of view provided according to the invention.

In an embodiment of the invention it is provided that the image acquisition system in the transport position is arranged at least substantially completely in or behind a protective cover arranged on the lift column. It can preferably be provided that a cover of the image acquisition system closes the protective cover arrangement in the transport position.

In an embodiment of the invention it is provided that a lighting device is arranged on the jib beneath the image acquisition system in the region of the tip of the jib, wherein it is preferably provided that the lighting device is arranged sunk in the jib in such a way that it is retractable jointly with the jib into the lift column. The arrangement adopted here in the region of the tip permits on the one hand optimum illumination in the field of view of the image acquisition system while on the other hand it avoids blinding of the image acquisition system. If the lighting device is arranged sunk in the jib this affords optimum protection—in particular but not just—in the transport position. In addition a lighting device which is arranged in a sunk position does not impede movement of the jib.

It can preferably be provided that the lighting device includes at least one spotlight.

In an embodiment of the invention it is provided that the lift column and the jib includes an angle different from zero with the crane column in a vertical plane which has both the lift column and also the crane column. A vertically extending lift column would admittedly also be conceivable in itself. The selected inclined implementation of the lift column, upon extension of the jib, provides for a displacement of the image acquisition system relative to the crane column away from same and thus permits a better view into a region hidden by the crane column. The inclined implementation of the lift column means that in an extended state of the jib it is possible to achieve a great lateral spacing in respect of the crane column without corresponding extension being required in the transport position.

In that respect it is provided that a housing of a crane control, that is arranged on the crane column, is arranged in a lower region of the crane column. Accordingly the housing of the crane control does not conceal a view on to a support arrangement of the crane. Therefore there is no need for an additional image acquisition system in the region of the support arrangement.

In an embodiment of the invention it is provided that the image acquisition system has a computing unit which from signals of at least one camera of the image acquisition system computes visualisation data for a visualisation unit arranged outside the image acquisition system. Therefore so-to-speak a part of the computing involvement necessary for producing a representation (in particular compression of data) is shifted into the image acquisition system itself. Accordingly much less data has to be transmitted to the visualisation unit which is arranged outside the image acquisition system (that unit is usually disposed in a driving cab of a carrier vehicle of the crane), and that reduces the bandwidth required for that purpose.

In an embodiment of the invention it is provided that the image acquisition system has at least two cameras and there is provided an interface which collects signals of the at least two cameras and possibly—when the reference back to the above-described embodiment applies—communicates same to the computing unit. That reduces a connection complexity and cost (generally by way of cables, but it can also be wirelessly) from the individual cameras to the computing unit as the connection is only from the cameras to the (joint) interface. An even greater advantage is that the connection complexity and cost from the image acquisition system to a visualisation unit arranged outside same (for example in a driving cab of a carrier vehicle) is minimised. That facilitates the use of wireless connections.

In an embodiment of the invention it is provided that there is provided a device for producing an air curtain for at least one protective glass of the image acquisition system for preventing contamination of or moisture on the protective glass, wherein the device for producing the air curtain has an interface for linking to a compressed air supply of a carrier vehicle of the crane. A specific compressed air generation means on the crane is therefore not necessary. It is also not necessary to arrange a climate control assembly on the crane.

In this embodiment of the invention it is preferably provided that there is provided an air curtain control device which blocks production of the air curtain outside of operation of the image acquisition system. It is thus possible in that way to avoid a compressed air supply on the carrier vehicle being exhausted.

In an embodiment of the invention it is provided that there is provided a temperature control device for the image acquisition system, wherein the temperature control device has an interface for temperature control medium, preferably compressed air, that is provided by a carrier vehicle of the crane, and/or for the power supply for the temperature control device.

BRIEF DESCRIPTION OF THE DRAWINGS

Embodiments of the invention are discussed with reference to the Figures in which.

DETAILED DESCRIPTION OF THE INVENTION

Figure 1:
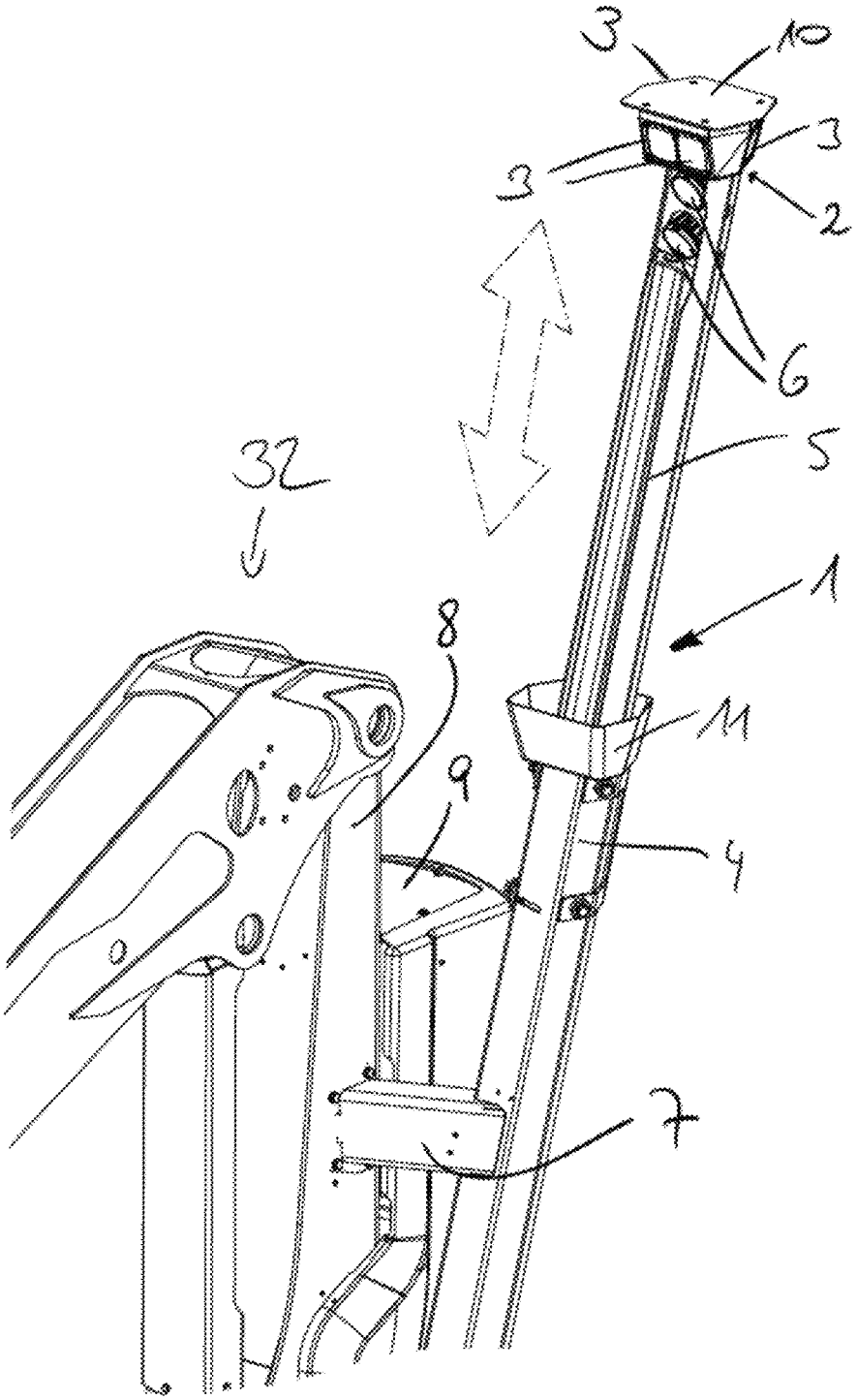
FIG. 1 is a perspective view of a crane with a lifting device and an image acquisition system.
Figure 4:
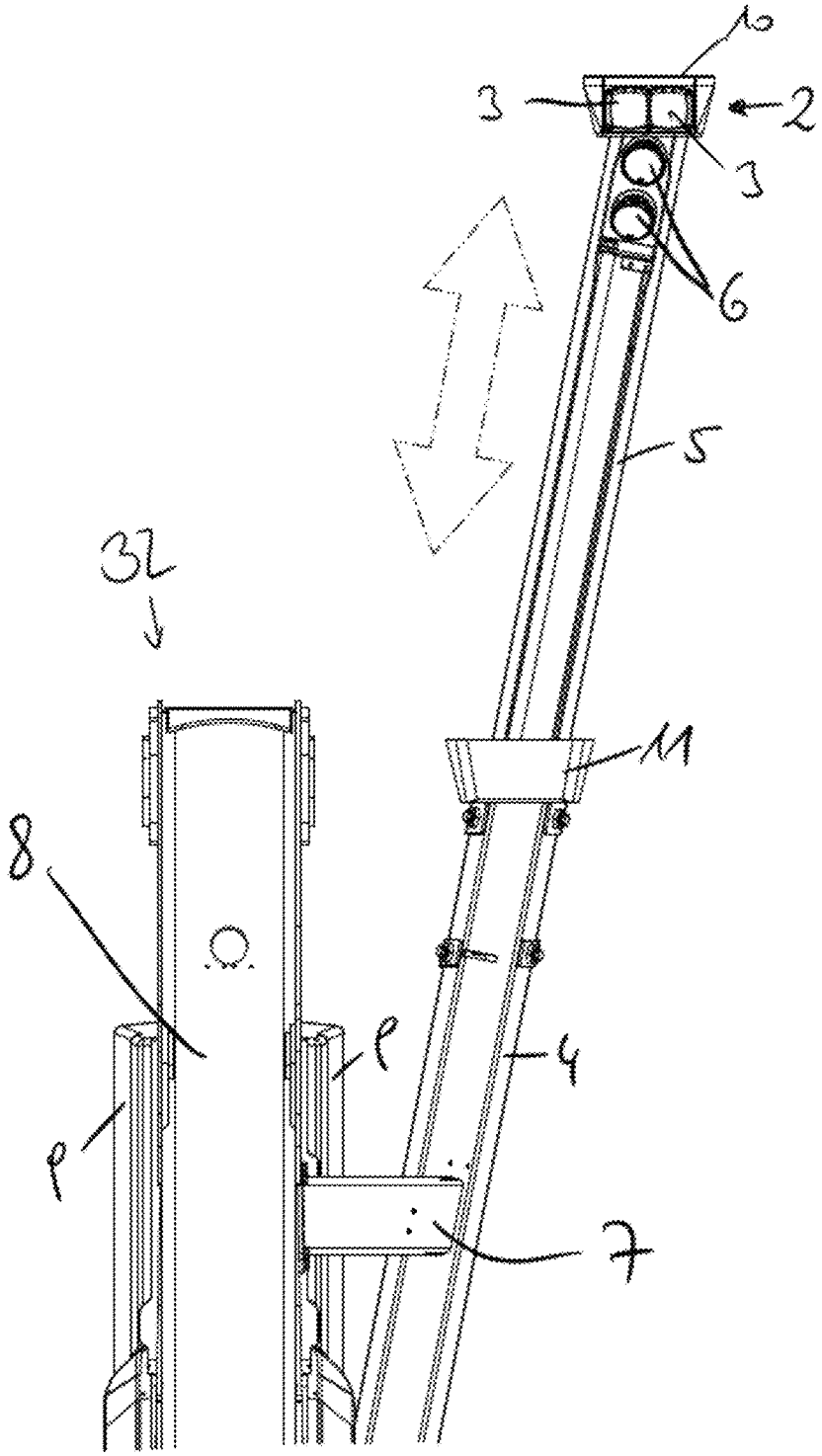
FIG. 4 is a front view of the crane of FIG. 1.
Figure 5:
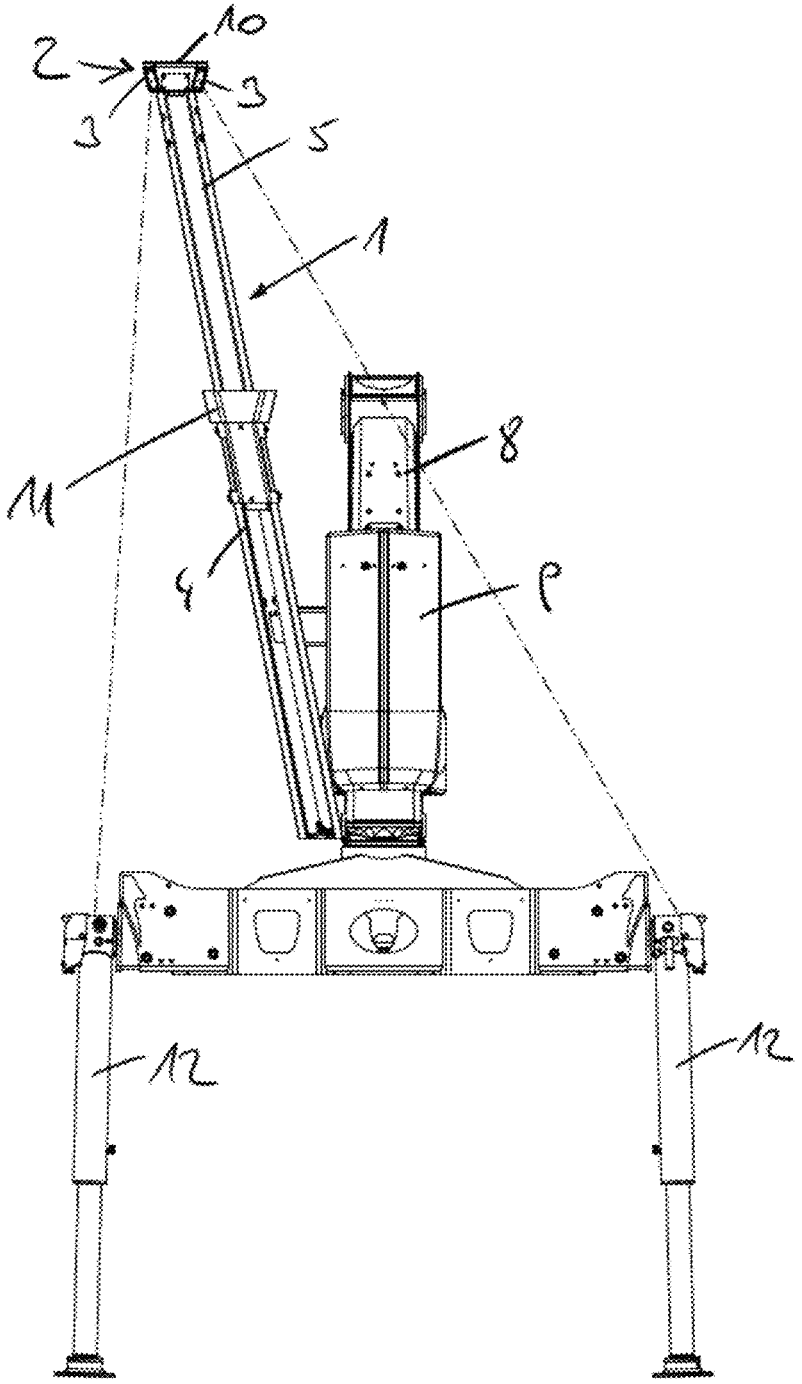
FIG. 5 is a rear view of the crane of FIG. 1.

FIG. 1 shows a perspective view of a crane 32 having a crane column 8 and a lifting device 4 arranged thereon by way of a strut 7, FIG. 4 shows a front view of the crane 32 and FIG. 5 shows a rear view of the crane 32. A support arrangement 12 of the crane 32 is additionally to be seen in FIG. 5.

The lifting device 1 has a lift column 4 and a jib 5 which extends in a straight line and which is retractable into and extendable from the lift column 4. An image acquisition system 2 is arranged on a tip of the jib 5, that forms a highest point of the jib 5.

The image acquisition system 2 can be raised and lowered by the lifting device 1 and serves for image acquisition of a region of a crane environment, that is not directly visible for an operator of the crane 32. It will also be appreciated that a region which is directly visible to an operator of the crane can also be viewed by the image acquisition system 2. The image acquisition system 2 is moveable upwardly by extension of the jib 5 out of the lift column 4 and can be lowered by retraction of the jib 5 into the lift column 4 into a transport position in which the jib 5 is disposed substantially completely in the lift column 4 and the image acquisition system 2 is moved towards the lift column 4.

In a vertical plane which extends both through the lift column 4 and also through the crane column 8 the lift column 4 and the jib 5 include an angle which is different from zero with the crane column 8 (see FIG. 4 and FIG. 5).

A housing 9 of a crane control, that is arranged on the crane column 8, is disposed in a lower region of the crane column 8. As shown in FIG. 5 by the dash-dotted lines emanating from the image acquisition system 2 that arrangement of the housing 9 provides that the housing 9 of the crane control does not hide a view on to a support arrangement 12 of the crane 5. Therefore there is no need for an additional image acquisition system in the region of the support arrangement 12.

The image acquisition system 2 is arranged rigidly relative to the tip of the jib 5 and in the illustrated embodiments includes four cameras 3 arranged in a common housing which is closed by a cover 10.

In the illustrated view the jib 5 is substantially completely extended from the lift column 4. The image acquisition system 2 is moved away from the lift column 4 by virtue of the extension of the jib 5. In the retracted state of the jib 5 the image acquisition system 2 in the transport position is substantially completely in or behind a protective cover 11 arranged on the lift column 4 and is thereby protected from external influences.

Arranged beneath the image acquisition system 2 in the region of the tip of the jib 5 is a lighting device including two spotlights 6 on the jib 5, wherein the lighting device is arranged sunk in the jib 5 (see FIG. 3*a*) in such a way that it is retractable jointly with the jib 5 into the lift column 4.

Figure 2:
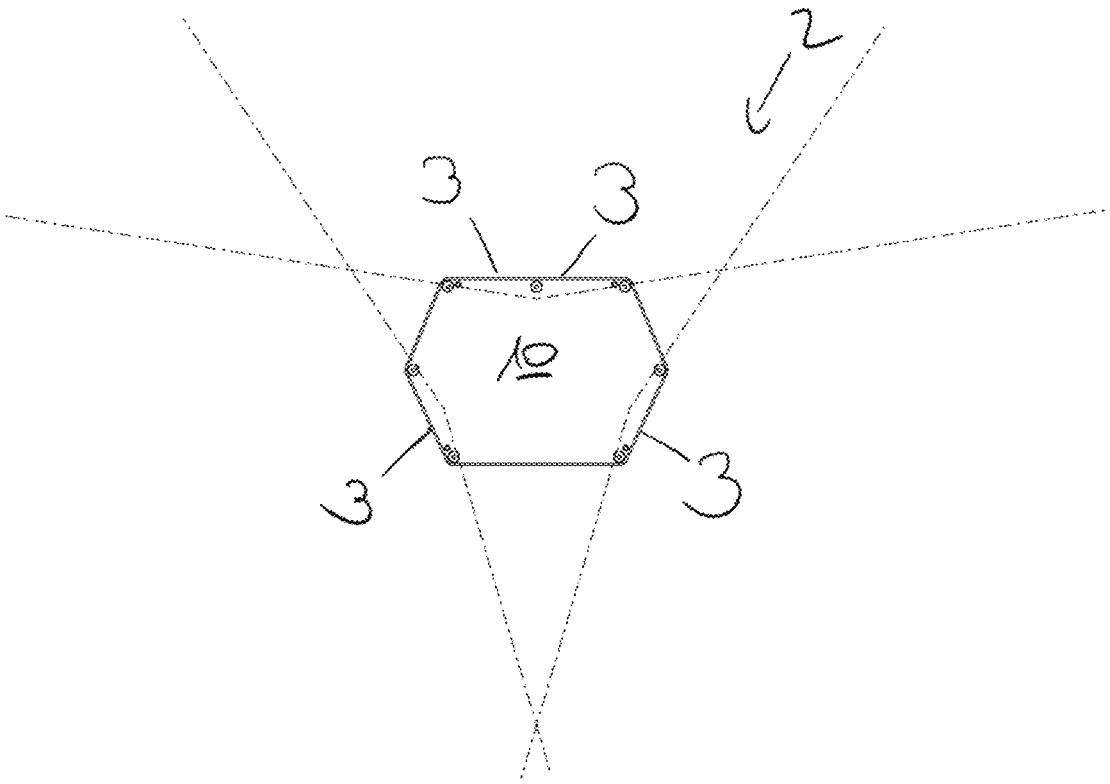
FIG. 2 is a plan view of an image acquisition system.

FIG. 2 shows a plan view of an image acquisition system 2. The dash-dotted lines illustrate the field of view acquired by the respective cameras 3 in a horizontal plane. Stereoscopic image acquisition of a portion of the entire field of view viewed can be effected by two of the cameras 3. As can be seen from FIGS. 1, 4 and 5 the stereoscopically imaged portion is directed in the direction of a crane arm arranged on the crane column 8—and thus in the direction of an operative region of a working implement which can be arranged thereon.

Figure 3A:
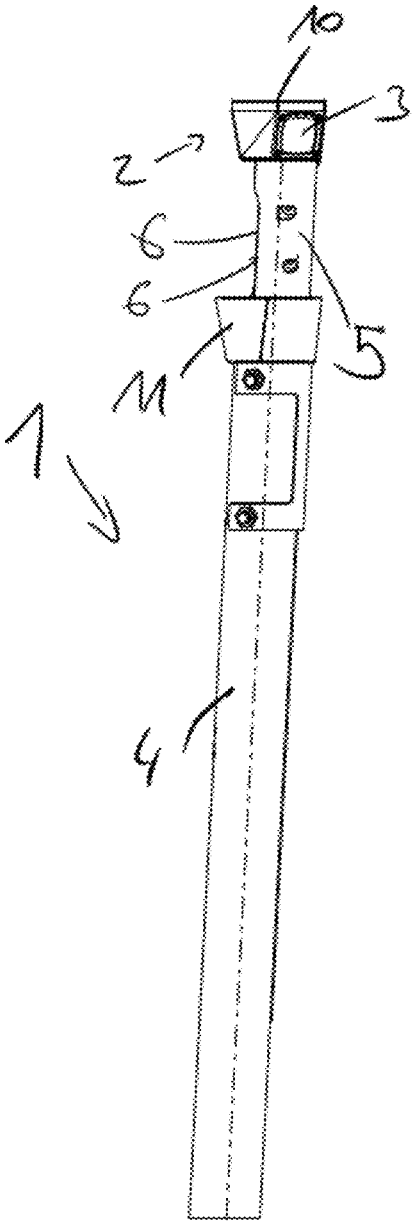
FIGS. 3*a* and 3*b* are a side view and a rear view of a lifting device and an image acquisition system in isolation.
Figure 3B:
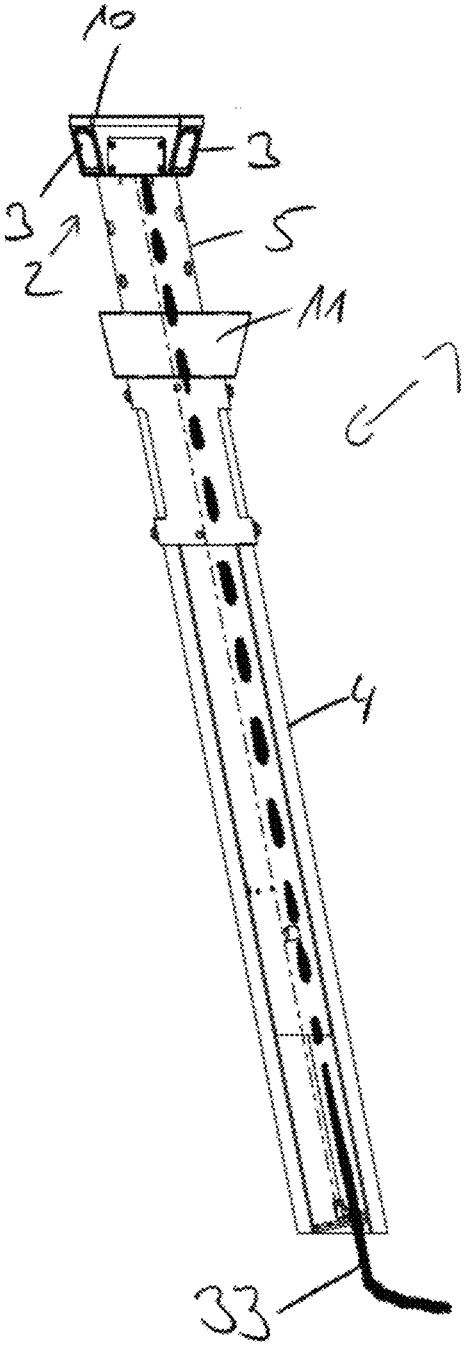

FIG. 3*a* shows a side view and FIG. 3*b* shows a rear view of a lifting device 1 with an image acquisition system 2 in a partially extended state of the jib 5 from the lift column 4 in isolation. FIG. 3*b* shows a wiring arrangement 33 which extends in the interior of the lifting device 1 and which can include power supply and data lines for the spotlights 6 and for the cameras 3. Unlike the situation shown in FIGS. 1, 4 and 5 the lifting device 1 can be arranged separately from the crane column 8.

Figure 6:
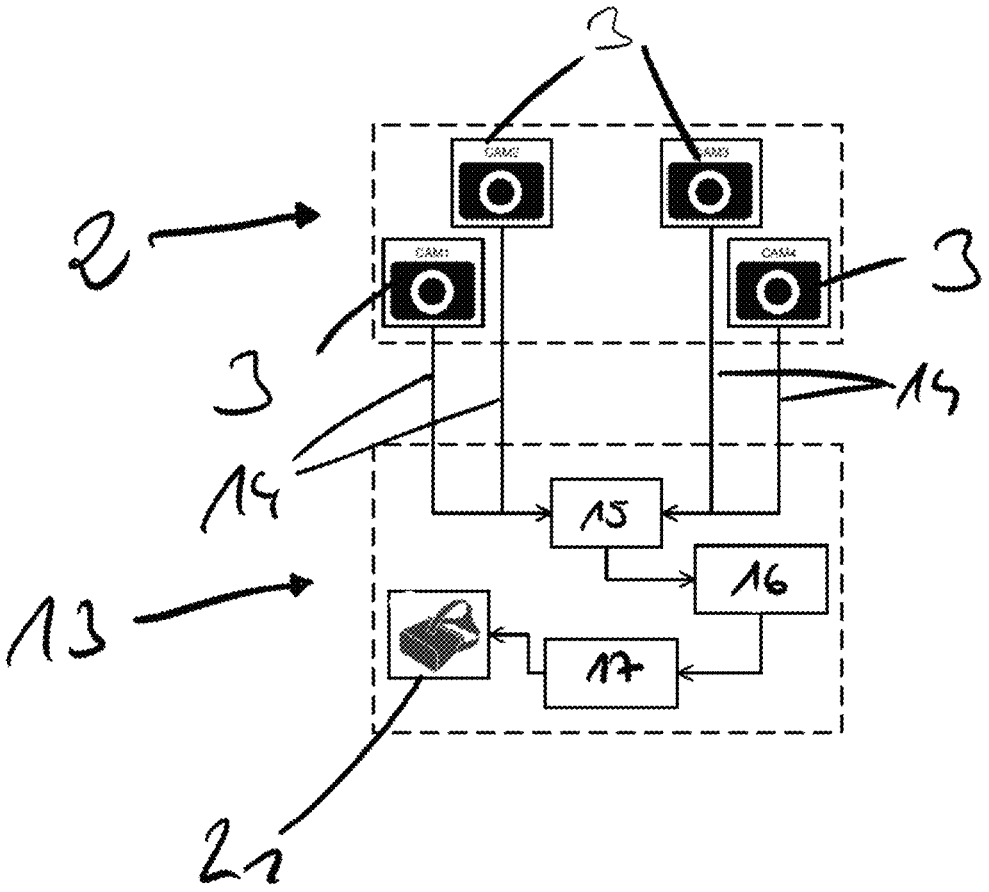
FIG. 6 is a diagrammatic view of an image acquisition system according to the state of the art.

FIG. 6 shows a diagrammatic view of an image acquisition system 2 according to the state of the art. The image acquisition system 2 includes a plurality of cameras 3. The signals output by those cameras 3 are sent by way of lines 14 to a cab interface 15 arranged in a cab 13 of a carrier vehicle 35 (not shown here) (or to an operating position of a crane). A cab computing unit 16 which is also arranged in the cab 13 is used to compute from the signals image data which can be forwarded to a cab visualisation unit 17. The image data can be forwarded to a display device 21 by the cab visualisation unit 17.

Figure 7:
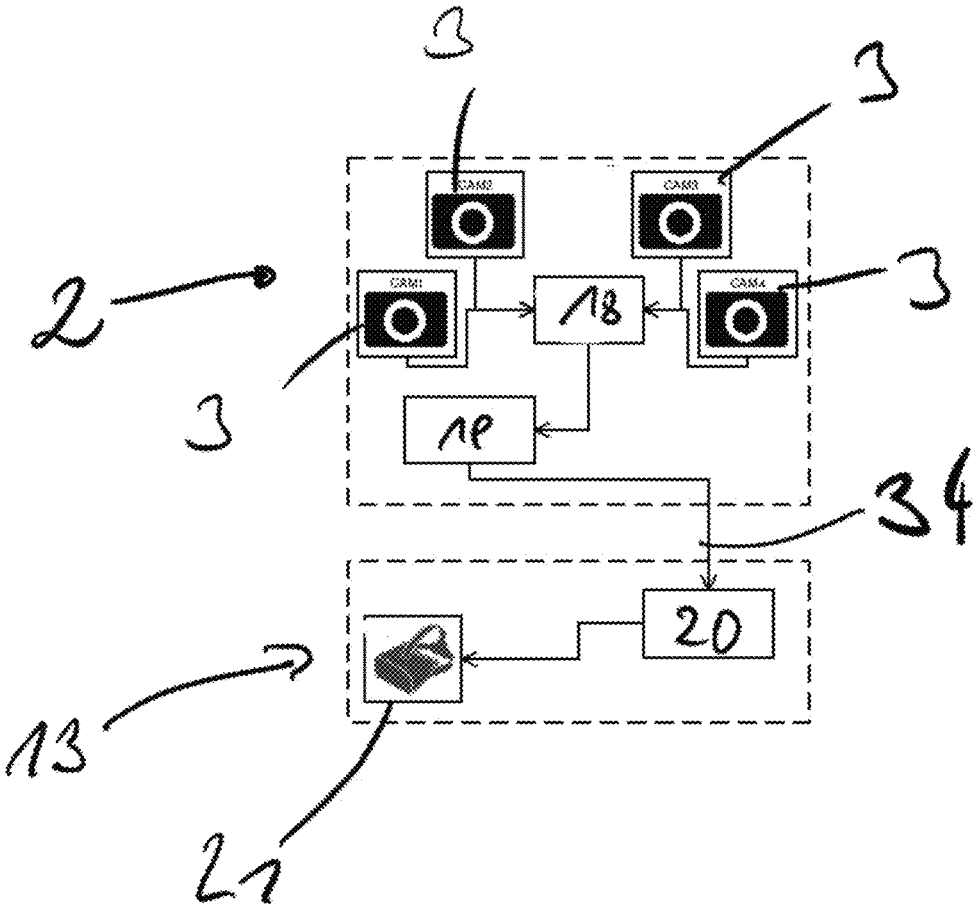
FIG. 7 is a diagrammatic view of an embodiment of a proposed image acquisition system.

FIG. 7 shows a diagrammatic view of an embodiment of a proposed image acquisition system 2. The image acquisition system 2 includes a plurality of cameras 3. The signals output by those cameras 3 are sent, possibly by way of separately provided signal lines, to an interface 18 arranged in the image acquisition system 2. Image data are computed from the signals by a computing unit 19 also arranged in the image acquisition system 2. The cameras 3, the interface 18 and the computing unit 19 can be in the form of a common assembly and can be arranged jointly in the housing of the image acquisition system 2. By way of preferably a data line 34 the image data can be passed to a visualisation unit 20 arranged in a cab 13 of a carrier vehicle 35 (not shown here) (or in an operating position of a crane), from which visualisation unit 20 data can be in turn forwarded to a display device 21. Unlike the situation illustrated the image data can be wirelessly transmitted from the image acquisition system 2 to the visualisation unit 20.

Figure 8:
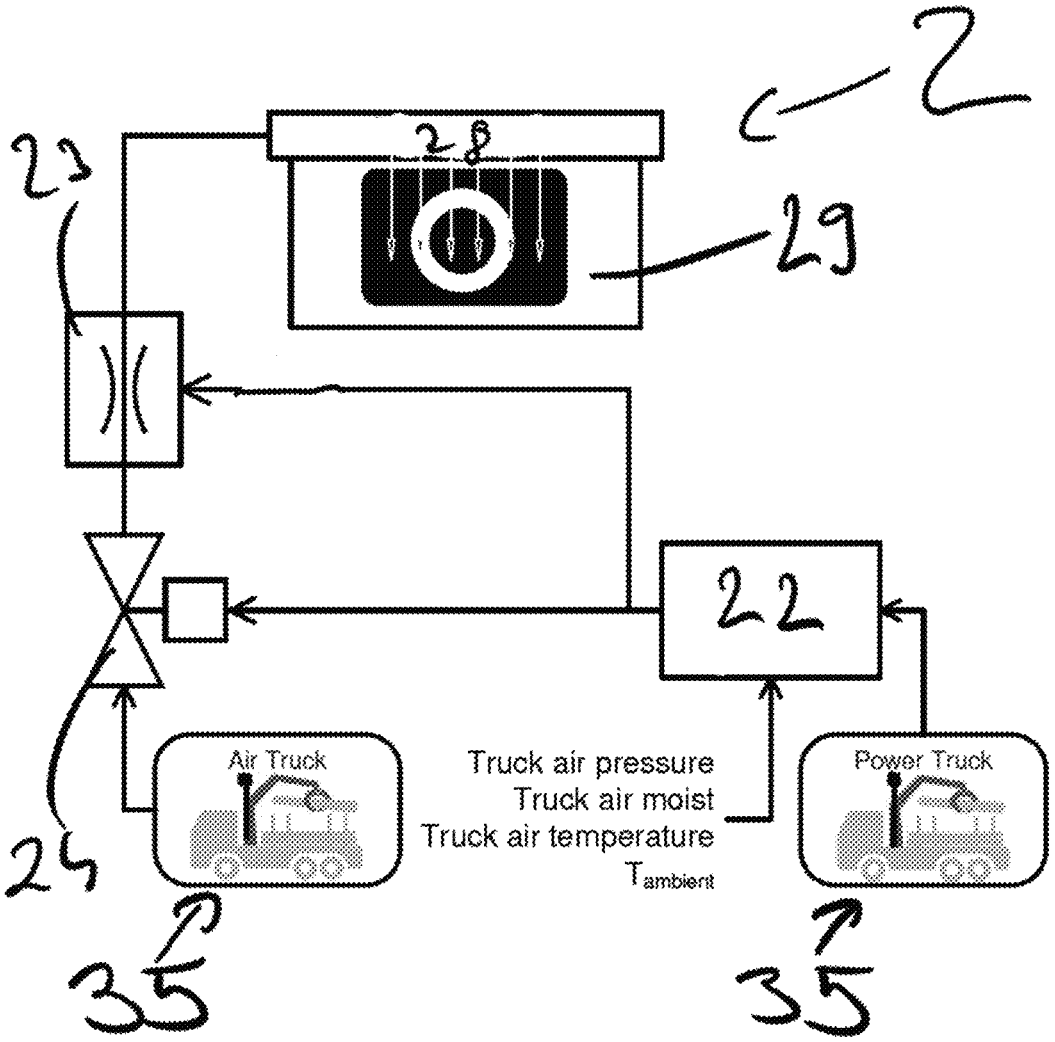
FIG. 8 is a diagrammatic view of a further proposed image acquisition system.

FIG. 8 shows a diagrammatic view of an image acquisition system 2 having a protective glass 29 and a device for producing an air curtain 28. An air curtain can be built up along a side of the protective glass 29, that faces away from the cameras 3, with the device for producing the air cushion 28. The device for producing the air cushion 28 is connected by way of an interface to a compressed air supply and/or a power supply of a carrier vehicle 35 of the crane 32 and has an air curtain control device 22, with which a switching valve 24 and a throttle means 23 in the compressed air supply line are controllable. Input parameters for the air curtain control device 22 can be: air pressure of the compressed air supply, air humidity of the compressed air, temperature of the compressed air and ambient temperature. Control of the switching valve 24 and/or the throttle means 23 can be effected in dependence on the input parameters. The device for producing an air curtain 28—in particular the air curtain control device 22, the switching valve 24 and the throttle means 23—can be disposed in a housing of the image acquisition system 2.

Figure 9:
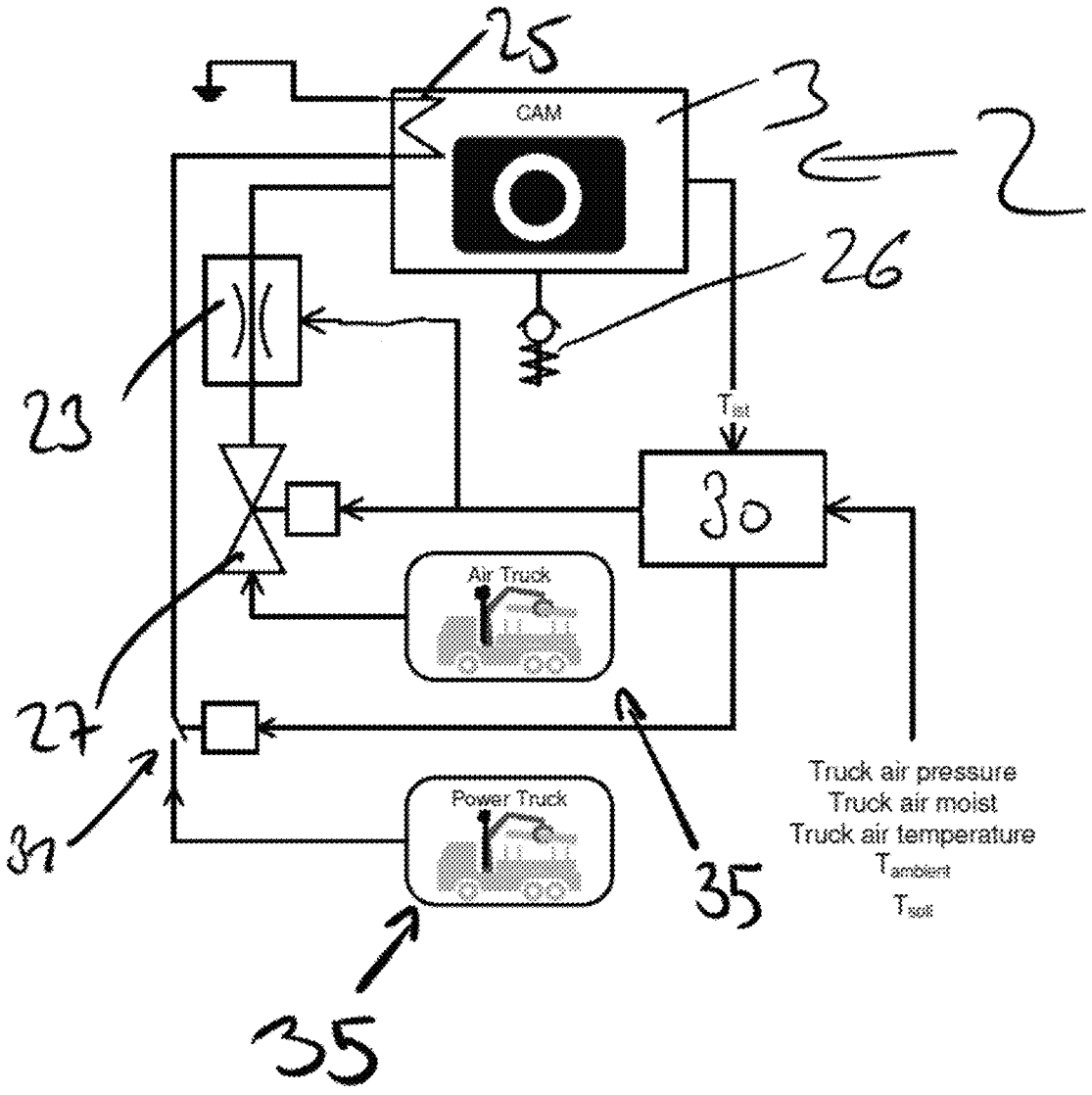
FIG. 9 is a diagrammatic view of a further proposed image acquisition system.

FIG. 9 shows a diagrammatic view of an image acquisition system 2 with a temperature control device for the image acquisition system 2, wherein the temperature control device is connected by way of an interface to a compressed air supply and/or a power supply of a carrier vehicle 35 of the crane 32. Compressed air can be passed by way of a compressed supply line into the interior of a housing of the image acquisition system 2, in which the cameras 3 are disposed. Arranged in the compressed air supply line are a control valve 27 and a throttle means 23 controllable by a temperature control arrangement 30. The compressed air can serve to cool the cameras 3 in the housing. Compressed air introduced into the housing can escape by way of a (non-return) pressure relief valve 26. An internal region of the housing can be heated by way of a heating means 25 activatable by a switch 31, in which case the switch 31 is controllable by the temperature control arrangement 30. Input parameters for the temperature control arrangement 30 can be: air pressure of the compressed air supply, air humidity of the compressed air, temperature of the compressed air, ambient temperature, actual temperature in the interior of the housing and target temperature. Actuation of the control valve 27 and/or the throttle means 23 and/or the switch 31 can be effected in dependence on the input parameters. The temperature control device—in particular the temperature control arrangement 30, the control valve 27, the throttle means 23, the switch 31 and the heating means 25—can be arranged in the housing of the image acquisition system 2.

LIST OF REFERENCES

1 lifting device
2 image acquisition system
3 camera
4 lift column
5 jib
6 spotlight
7 strut
8 crane column
9 housing of a crane control
10 cover of a housing of the image acquisition system
11 protective cover
12 support arrangement
13 cab of a carrier vehicle or operating position of the crane
14 lines
15 cab interface
16 cab computing unit
17 cab visualisation unit
18 interface
19 computing unit
20 visualisation unit
21 display device
22 air curtain control device
23 throttle means
24 switching valve
25 heating arrangement
26 pressure relief valve
27 control valve
28 air curtain
29 protective glass
30 temperature control arrangement
31 switch of the temperature control arrangement
32 crane
33 cable arrangement
34 data line
35 carrier vehicle

The invention claimed is:

1. A crane comprising:

a crane column;

a lifting device arranged on the crane column; and an image acquisition system which is arranged to be raised and lowered by the lifting device for acquisition of a region of a crane environment, that cannot be directly viewed by an operator of the crane, wherein the image acquisition system is arranged on a jib of the lifting device, and the jib extends in a straight line, wherein the image acquisition system is moveable upwardly by an extension of the jib from a lift column, and is lowerable by retraction of the jib into the lift column into a transport position in which the jib is fully retracted and the image acquisition system is moved towards the lift column, wherein the image acquisition system is arranged on a tip of the jib, the tip forming a highest point of the jib, and wherein the lift column and the jib include an angle different from zero with the crane column in a vertical plane which has both the lift column and also the crane column.

2. The crane according to claim 1, wherein the image acquisition system is arranged rigidly relative to the tip of the jib.

3. The crane according to claim 1, wherein the image acquisition system has at least one camera.

4. The crane according to claim 1, wherein the image acquisition system in the transport position is arranged in or behind a protective cover arranged on the lift column.

5. The crane according to claim 1, wherein a lighting device is arranged on the jib beneath the image acquisition system in a region of the tip of the jib.

6. The crane according to claim 5, wherein the lighting device includes at least one spotlight.

7. The crane according to claim 1, wherein a housing of a crane control, that is arranged on the crane column, is arranged in a lower region of the crane column.

8. The crane according to claim 1, wherein the image acquisition system has a computing unit which from signals of at least one camera of the image acquisition system computes visualization data for a visualization unit arranged outside the image acquisition system.

9. The crane according to claim 1, wherein the image acquisition system has at least two cameras, and an interface is provided which collects signals of the at least two cameras.

10. The crane according to claim 9, further comprising a device for producing an air curtain for at least one protective glass of the image acquisition system, wherein the device for producing the air curtain has an interface for linking to a compressed air supply of a carrier vehicle of the crane.

11. The crane according to claim 10, further comprising an air curtain control device which blocks production of the air curtain outside of operation of the image acquisition system.

12. The crane according to claim 1, further comprising a temperature control device for the image acquisition system, wherein the temperature control device has an interface for a temperature control medium that is provided by a carrier vehicle of the crane, and/or for a power supply for the temperature control device.

13. A carrier vehicle having the crane according to claim 1.

14. The crane according to claim 3, wherein the image acquisition system has at least three cameras.

15. The crane according to claim 14, wherein the at least three cameras are arranged in a common housing.

16. The crane according to claim 5, wherein the lighting device is arranged sunk in the jib so as to be retractable jointly with the jib into the lift column.

17. The crane according to claim 8, wherein the image acquisition system has at least two cameras, and an interface is provided which collects signals of the at least two cameras and communicates the signals of the at least two cameras to the computing unit.

18. The crane according to claim 12, wherein the temperature control medium is compressed air.

* * * * *